US011399226B2

(12) United States Patent
Kim

(10) Patent No.: US 11,399,226 B2
(45) Date of Patent: Jul. 26, 2022

(54) VOICE INPUT APPARATUS

(71) Applicant: LG ELECTRONICS INC., Seoul (KR)

(72) Inventor: Hyunki Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 9 days.

(21) Appl. No.: 17/258,411

(22) PCT Filed: Jul. 12, 2019

(86) PCT No.: PCT/KR2019/008651
§ 371 (c)(1),
(2) Date: Jan. 6, 2021

(87) PCT Pub. No.: WO2021/010499
PCT Pub. Date: Jan. 21, 2021

(65) Prior Publication Data

US 2021/0385564 A1 Dec. 9, 2021

(51) Int. Cl.

| | |
|---|---|
| ***H04R 1/04*** | (2006.01) |
| ***H04R 1/02*** | (2006.01) |
| ***H04R 19/01*** | (2006.01) |
| ***H04R 31/00*** | (2006.01) |

(52) U.S. Cl.
CPC ..... *H04R 1/04* (2013.01); *H04R 1/021* (2013.01); *H04R 19/016* (2013.01); *H04R 31/006* (2013.01)

(58) Field of Classification Search
CPC ..... H04R 1/04; H04R 1/021; H04R 19/016; H04R 31/006
See application file for complete search history.

(56) References Cited

U.S. PATENT DOCUMENTS

2011/0170728 A1* 7/2011 Chen ..... H04R 1/021 381/365

* cited by examiner

*Primary Examiner* — Mark Fischer
(74) *Attorney, Agent, or Firm* — Lee, Hong, Degerman, Kang & Waimey PC

(57) ABSTRACT

Disclosed is a voice input apparatus including: a panel in which a voice input hole is formed; a circuit board which is disposed below the panel, and has a voice passing hole and a binding hole formed in a position corresponding to the voice input hole; a microphone which is disposed below the circuit board, and provided with a voice receiving hole in a position corresponding to the voice passing hole; and a sealer which guides a voice inputted through the voice input hole to the voice passing hole, wherein the sealer includes: a guide pipe which is formed in a cylindrical shape having a hollow and disposed between the panel and the circuit board, has an upper surface defining an upper end of the hollow is in contact with a bottom surface of the panel while surrounding the voice input hole, and has a lower surface defining a lower end of the hollow is in contact with an upper surface of the circuit board while surrounding the voice passing hole; and a hook which protrudes from the lower surface of the guide pipe and passes through the binding hole to be caught by a bottom surface of the circuit board.

12 Claims, 7 Drawing Sheets

VOICE INPUT APPARATUS

CROSS-REFERENCE TO RELATED APPLICATIONS

This application is the National Stage filing under 35 U.S.C. 371 of International Application No. PCT/KR2019/008651, filed on Jul. 12, 2019, the contents of which are all incorporated by reference herein in their entirety.

TECHNICAL FIELD

The present disclosure relates to a voice input apparatus that receives a voice for controlling an appliance.

BACKGROUND ART

There are various appliances, such as TV, air conditioner, audio, cleaner, washing machine, air purifier, clothing manager, refrigerator, oven, dishwasher, water purifier, and dryer, in the home. The appliances are controlled by a wireless communication-based remote control apparatus. In general, a single control apparatus controls a single appliance, but there is an integrated control apparatus that manages and controls several appliances together.

With the development of voice recognition technology, recently, a control apparatus for recognizing a user's voice command and controlling an appliance based on the voice command has been widely used. Such a control apparatus is interoperable with a voice input apparatus that provides a voice-based user interface. The voice input apparatus includes a microphone and a speaker.

The user interface is configured to provide a user with various information such as guidance, response, and notification through the speaker, and to receive various instructions such as selection, execution, inquiry, and control of a menu from the user through the microphone.

In order for the voice recognition-based two-way user interface to operate accurately, the user's voice must be accurately inputted to the microphone, and in this respect, there is a need to find an optimal sealing structure that allows the user's voice to reach the microphone without leaking.

DISCLOSURE

Technical Problem

The present disclosure has been made in view of the above problems, and a first object of the present disclosure is to provide a voice input apparatus that allows the voice inputted through a voice input hole formed in a panel to reach a microphone without a loss.

A second object of the present disclosure is to provide a voice input apparatus that prevents unnecessary noise other than the user's voice inputted through the voice input hole from entering the microphone.

A third object of the present disclosure is to provide a voice input apparatus that simply achieves the assembly of mechanism for sound sealing.

The objects of the present disclosure are not limited to the above-mentioned objects, and other objects that are not mentioned will be clearly understood by those skilled in the art from the following description.

Technical Solution

In an aspect, there is provided a voice input apparatus including: a panel in which a voice input hole is formed; a circuit board which is disposed below the panel, and has a voice passing hole and a binding hole formed in a position corresponding to the voice input hole; a microphone which is disposed below the circuit board, and provided with a voice receiving hole in a position corresponding to the voice passing hole; and a sealer which guides a voice inputted through the voice input hole to the voice passing hole.

The sealer includes: a guide pipe which is formed in a cylindrical shape having a hollow and disposed between the panel and the circuit board, has an upper surface defining an upper end of the hollow is in contact with a bottom surface of the panel while surrounding the voice input hole, and has a lower surface defining a lower end of the hollow is in contact with an upper surface of the circuit board while surrounding the voice passing hole; and a hook which protrudes from the lower surface of the guide pipe and passes through the binding hole to be caught by a bottom surface of the circuit board.

The guide pipe is made of a compressible soft material. The voice input apparatus further includes a speaker room provided below the microphone; and a speaker disposed inside the speaker room. The circuit board is spaced apart from an upper surface portion of the speaker room by a set distance, and the voice input apparatus further includes a bridge which connects the speaker room and the panel to maintain a distance between the panel and the circuit board to be smaller than a length of the guide pipe when not compressed. The voice input apparatus further includes a board supporter which is extended upward from the upper surface portion of the speaker room by the set distance and supports the circuit board. An upper end of the bridge and the panel are screwed together. The sealer is made of silicon. When viewed from above, the hollow is positioned inside the voice input hole. When viewed from above, the voice passing hole is positioned inside the hollow.

In another aspect, there is provided a voice input apparatus including: a panel in which a voice input hole is formed; a circuit board which is disposed below the panel, and has a voice passing hole and a first binding hole formed in a position corresponding to the voice input hole; a microphone which is disposed below the circuit board, and provided with a voice receiving hole in a position corresponding to the voice passing hole; a hook fixing member which is disposed below the circuit board to accommodate the microphone, and has a second binding hole: and a sealer which guides a voice inputted through the voice input hole to the voice passing hole, wherein the sealer includes: a guide pipe which is formed in a cylindrical shape having a hollow and disposed between the panel and the circuit board, has an upper surface defining an upper end of the hollow is in contact with a bottom surface of the panel while surrounding the voice input hole, and has a lower surface defining a lower end of the hollow is in contact with an upper surface of the circuit board while surrounding the voice passing hole; and a hook which protrudes from the lower surface, and passes through the first binding hole and the second binding hole sequentially to be caught by a bottom surface of the hook fixing member.

The hook fixing member comprises a receiving portion having an opening formed on an upper surface, and the microphone is accommodated into the receiving portion through the opening. In the hook fixing member, a circumference of the opening is in close contact with the bottom of the circuit board, in a state where the hook is caught by the bottom surface of the hook fixing member. The hook fixing member is made of a soft material.

Advantageous Effects

The voice input apparatus according to the present disclosure has the following effects.

First, the voice is guided by the hollow formed in the sealer from the voice input hole formed in the panel to the voice passing hole formed in the circuit board, thereby preventing the leakage of voice and the penetrating of noise into the sealer.

Second, the workability in the manufacturing process is improved by fixing the sealer by a mechanical coupling between the hook and the binding hole, and the sealer can be firmly fixed with no stiffness change in comparison with the method of fixing the sealer using the adhesiveness of a double-sided tape.

The effects of the present disclosure are not limited to the effects mentioned above, and other effects not mentioned can be clearly understood by those skilled in the art from the description of the claims.

MODE FOR DISCLOSURE

Figure 1:
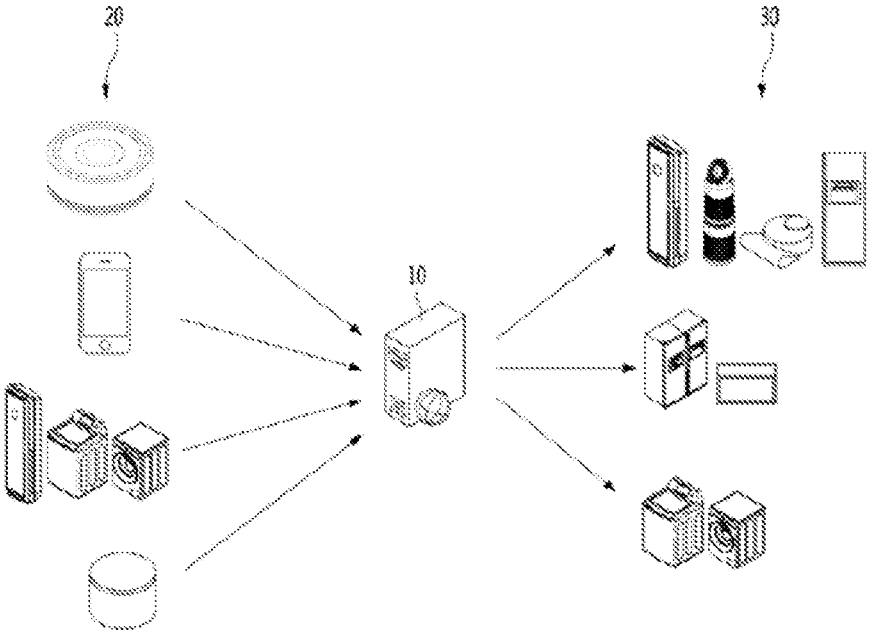
FIG. 1 is a conceptual diagram of an appliance control system according to an embodiment of the present disclosure.

Hereinafter, preferred embodiments of the present disclosure will be described with reference to the accompanying drawings. In describing the present embodiment, the same designations and the same reference numerals are used for the same components, and further description thereof will be omitted.

FIG. 1 is a conceptual diagram of an appliance control system according to an embodiment of the present disclosure. Referring to FIG. 1, the appliance control system may include an appliance control apparatus 10, at least one voice input apparatus 20, and at least one appliance 30. The appliance 30 is not limited to a home appliance used at home, and may be an office appliance used in a work space.

The appliance control apparatus 10 may receive various types of control commands from the voice input apparatus 20, and transmit a control signal based on the received control command to the appliance 30.

The appliance 30 may include a communication module for communication connection with the appliance control apparatus 10. For example, the appliance 30 may include a wireless internet module such as Wi-Fi.

The appliance control apparatus 10 may receive information on an event generated in the appliance 30, and notify the received information to the user through the voice input apparatus 20. That is, the appliance control apparatus 10 may serve as a hub or a server. Specific configuration and operation of the appliance control apparatus 10 will be described in more detail later.

The voice input apparatus 20 may receive a control command for controlling the appliance 30 from the user, and transmit the received control command to the appliance control apparatus 10. The control command may be in the form of a voice, and the voice input apparatus 20 may include a microphone 221 (see FIG. 4) for receiving a voice. The voice input apparatus 20 may receive a control command through a touch or a button in addition to voice.

In addition, the voice input apparatus 20 may include an output means such as a speaker 231, a display 232, or the like. Accordingly, the voice input apparatus 20 may output a processing result or response according to the inputted control command, or may output information or data received from the appliance control apparatus 10. The information or data may be related to various events generated in the appliance 30.

The voice input apparatus 20 may be a mobile terminal such as smartphone and tablet PC, an audio output device (e.g., an artificial intelligence speaker) having a built-in input means such as a microphone, and an appliance (e.g., air conditioner, washing machine, or the like that are equipped with a microphone) having the built-in input means.

Figure 2:
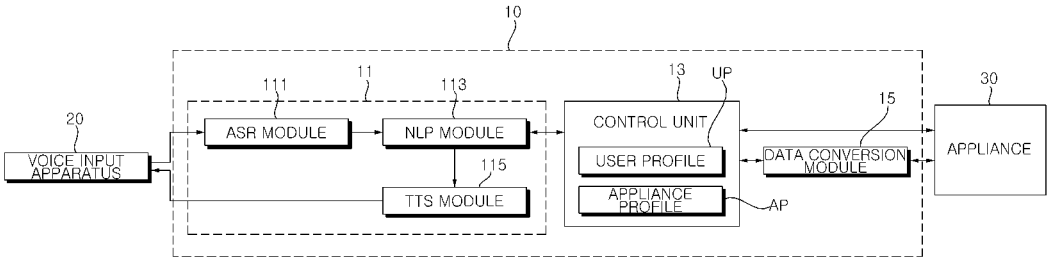
FIG. 2 is a schematic block diagram of an appliance control apparatus according to an embodiment of the present disclosure.

FIG. 2 is a schematic block diagram of an appliance control apparatus according to an embodiment of the present disclosure. Referring to FIG. 2, the appliance control apparatus 10*a* may include a voice processing unit 11 and a control unit 13. Each of the voice processing unit 11 and the control unit 13 may be implemented in a separate server form or may be integrated in a single server.

A user's voice (or voice command) inputted through the voice input apparatus 20 may be transmitted to the voice processing unit 11. The voice may include a control command for a specific appliance.

The voice processing unit 11 may process the received voice, convert the received voice into text, and acquire a control command for a specific appliance from the converted text. The voice processing unit 11 may transmit the acquired control command to the control unit 13.

Furthermore, the voice processing unit 11 may convert a message or various information in the form of text or code transmitted from the control unit 13 into a voice form, and transmit the converted voice form guide message or various information to the voice input apparatus 20.

In detail, the voice processing unit 11 may include an automatic speech recognition (ASR) module 111, a natural language processing (NLP) module 113, and a text to speech (TTS) module 115. The ASR module 111, the NLP module 113, and the TTS module 115 may be implemented in a single server, or may be implemented in separate servers respectively.

The ASR module 111 may convert a voice transmitted from the voice input apparatus 20 into text by using a known automatic speech recognition technology.

The NLP module 113 may check (analyze) whether a control command that can be processed by the control unit 13 or the appliance 30 is contained from the converted text. For example, the NLP module 113 may acquire a keyword for identifying the appliance 30 and/or a keyword related to the function or operation of the appliance 30 from the natural language corresponding to the converted text. The NLP module 113 may check the control command based on the acquired keyword.

Alternatively, the NLP module 113 may generate text in a natural language form containing the message or information based on the message or information transmitted from the control unit 13, and transmit the generated text to the TTS module 115.

The TTS module 115 may convert the text transmitted from the NLP module 113 into voice, and transmit the converted voice to the voice input apparatus 20.

The control unit 13 may receive a control command for the appliance 30 from the voice processing unit 11, and generate a control signal corresponding to the received control command. The control unit 13 may transmit the generated control signal to the appliance 30.

Meanwhile, the control unit 13 may generate the control signal based on a user profile UP and an appliance profile AP.

The user profile UP may include information related to appliances possessed by the user of the voice input apparatus 20. According to an embodiment, the user profile UP may further include various information such as product information (model information) of the appliances possessed by the user, a driving history, a usage pattern, an error history, a repair history, and the like for each of the possessed appliances.

According to an embodiment, the appliances possessed by the user are grouped based on a reference such as space or function, and only a representative appliance of each group may be directly connected to the control unit 13. For example, when an air cleaner among the appliances located in the living room is provided with only a short range communication module and cannot be directly connected to the control unit 13, the air cleaner may be connected to the control unit 13 through an air conditioner. In this case, among the appliances located in the living room, the air conditioner may correspond to the representative appliance.

The control unit 13 may control the remaining appliances through the representative appliance. To this end, the user profile UP may further include group information of the appliances, representative appliance information, and/or connection information between the appliances.

The appliance profile (AP) may include information related to the functions (modes) supported by each of the products (models) of the appliance, a data format (e.g., code information) for each of the functions, and the like.

The control unit 13 may generate the control signal based on the control command, the user profile UP, and the appliance profile AP. For example, when the control command includes a command for driving the air conditioner in a dehumidification mode, the control unit 13 may acquire product information (model information) of the air conditioner possessed by the user from the user profile UP. In addition, the control unit 13 may acquire code information related to the dehumidification mode of the model of the air conditioner possessed by the user from the appliance profile AP. The control unit 13 may generate a control signal for driving the dehumidification mode of the air conditioner by using the acquired code information. The control unit 13 transmits the generated control signal to the air conditioner, and the air conditioner may activate the dehumidification mode in response to the received control signal.

Meanwhile, in the appliance 30, the code information for a specific function may be different according to a detailed model. That is, the code information may be fragmented according to the model. In this case, in order for the control unit 13 to generate a control signal based on the control command, an additional process of acquiring code information for each of the models may be necessary. Since the control unit 13 generates a control signal by processing each of a plurality of control commands received from each of the plurality of users, the additional process may cause an increase in load of the control unit 13 and a delay in processing speed.

Accordingly, the appliance control apparatus 10 may further include a data conversion module 15 that performs an operation of generating a control signal having code information related to the model of a target appliance (or a control target appliance). The data conversion module 15 may be implemented as a separate server from the control unit 13, or may be implemented as a server together with the control unit 13. Alternatively, the data conversion module 15 may be implemented in a separate configuration from the appliance control apparatus 10. According to an embodiment, a plurality of data conversion modules 15 may be implemented, and each data conversion module 15 may be connected to the control unit 13.

When the data conversion module 15 exists, the control unit 13 may generate a control signal including integrated code information on a function to be controlled in the appliance based on the control command. The integrated code information may mean code information that is commonly set for a specific appliance product group.

The data conversion module 15 may convert the integrated code information included in the control signal into code information related to a model of the target appliance. To this end, the appliance profile AP may be provided in the data conversion module 15. In this case, the control unit 13 may transmit the model information of the target appliance along with the control signal to the data conversion module 15. The data conversion module 15 may convert the code information of the control signal based on the model information received from the control unit 13.

The data conversion module 15 may be implemented as a platform such as a kind of cloudlet assisting the control server 13. The data conversion module 15 may distribute the load of the control unit 13 through the above-described operation. Accordingly, the load of the control unit 13 may be effectively reduced, and the delay of the processing speed may be minimized.

Hereinafter, the configuration of the control unit 13 according to an embodiment of the present disclosure will be described with reference to FIG. 3.

Figure 3:
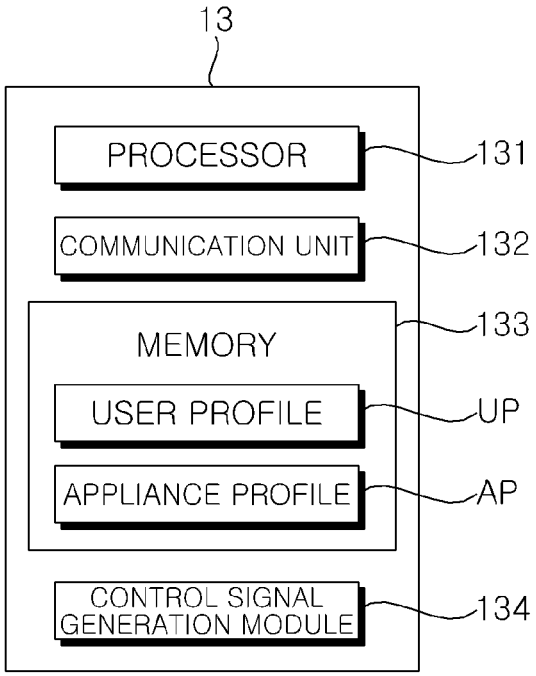
FIG. 3 is a schematic block diagram of the control apparatus shown in FIG. 2.

FIG. 3 is a schematic block diagram of the control apparatus shown in FIG. 2. Referring to FIG. 3, the control unit 13 may include a processor 131, a communication unit 132, a memory 133, and a control signal generation module 134.

The processor 131 may control the overall operation of the control unit 13. The processor 131 may receive a control command for the appliance 30 from the voice processing unit 11 through the communication unit 132. The processor 131 may control the control signal generation module 134 to generate a control signal based on the received control command. The processor 131 may transmit the generated control signal to the appliance 30 through the communication unit 132. To this end, the communication unit 132 may include at least one communication module such as an internet module, a mobile communication module, and the like.

According to an embodiment, the processor 131 may receive a response according to the control signal from the appliance 30 through the communication unit 132, or receive operation information or state information of the appliance 30. The processor 131 may transmit the received response, operation information, or state information to the voice processing unit 11 or the voice input apparatus 20. Alternatively, the processor 131 may control the control signal generation module 134 to generate a control signal based on the received response, operation information, or state information. The processor 131 may transmit the generated control signal to the appliance 30 through the communication unit 132.

The processor 131 may include at least one central processing unit (CPU), application processor (AP), integrated circuit, microcontroller, electrical unit for performing other functions, or the like.

The memory 133 may store various information, data, and algorithm for the operation of the control unit 13. The memory 133 may include a nonvolatile memory and a volatile memory. The nonvolatile memory may store the various information, data, and algorithm, and the volatile memory may temporarily store data acquired during the operation of the control unit 13 or information, data, algorithm, or the like loaded from the nonvolatile memory.

In particular, the memory 133 may store a user profile UP and an appliance profile AP. The user profile UP and the appliance profile AP may include information necessary for the control signal generation module 134 to generate a control signal for the target appliance.

As described above with reference to FIG. 2, the user profile UP may include information related to appliances possessed by a user of the voice input apparatus 20. According to an embodiment, the user profile UP may further include various information such as product information (model information) of appliances possessed by the user, a driving history, a usage pattern, an error history, a repair history, and the like for each of the possessed appliances.

The appliance profile (AP) may include information on the functions (modes) supported by each of the products (models) of the appliance, a data format (e.g., code information) for each of the functions, and the like.

According to an embodiment, when the control unit 13 is connected to a separate database device, the user profile UP and the appliance profile AP may be provided in the database device. The processor 131 may receive at least a portion of the user profile UP or at least a portion of the appliance profile AP from the database device and store it in the memory 133.

The control signal generation module 134 may generate a control signal corresponding to the control command received from the voice processing server 11 or the voice input apparatus 20. In FIG. 3, it is illustrated that the control signal generation module 134 is a separate configuration from the processor 131, but according to an embodiment, the control signal generation module 134 may be a configuration included in the processor 131.

The control signal generation module 134 may acquire model information of the appliance to be controlled according to the control command among the appliances possessed by the user from the user profile UP. In addition, the control signal generation module 134 may acquire data (e.g., code information) corresponding to a function to be performed according to the control command, from among data related to the model of the appliance to be controlled, from the appliance profile AP. The control signal generation module 134 may generate a control signal including the acquired data (code information).

According to an embodiment, when the appliance control apparatus 10 includes the data conversion module 15, the control signal generation module 134 may generate a control signal including integrated code information related to a function to be performed according to the control command. The data conversion module 15 may convert the integrated code information into code information corresponding to the model of the appliance to be controlled.

Hereinafter, a voice input apparatus according to an embodiment of the present disclosure will be described with reference to FIGS. 4 to 5.

Figure 4:
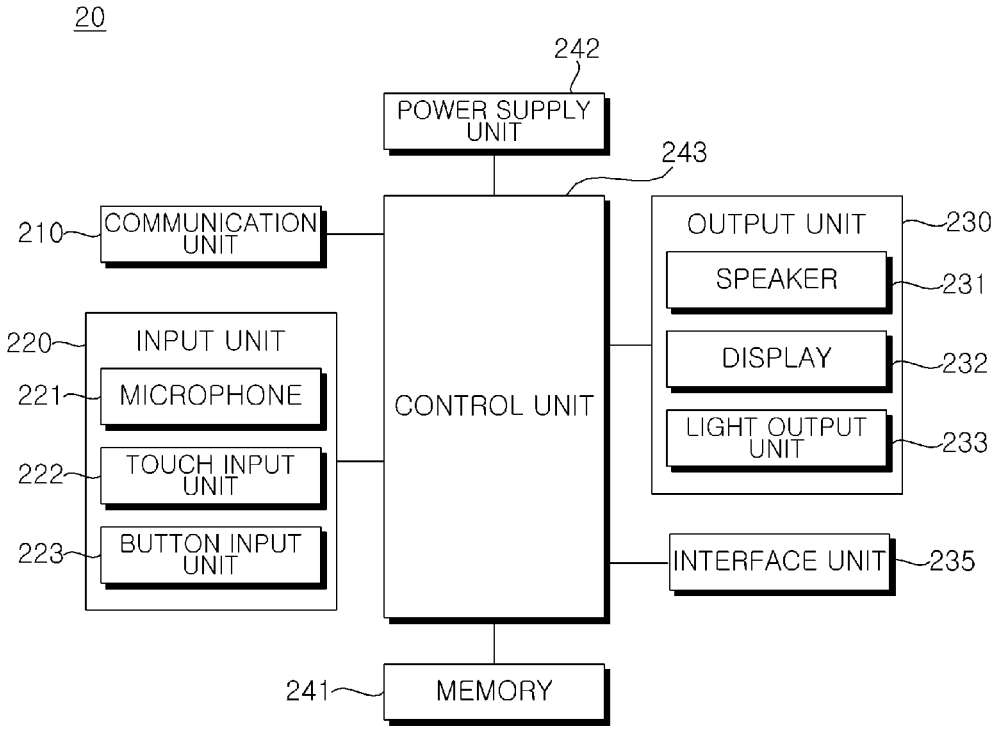
FIG. 4 is a schematic block diagram of a voice input apparatus shown in FIG. 1.

FIG. 4 is a schematic block diagram of a voice input apparatus shown in FIG. 1. Referring to FIG. 4, the voice input apparatus 20 may include a communication unit 210, an input unit 220, an output unit 230, a memory 241, a control unit 243, a power supply unit 242, and an interface unit 235.

The communication unit 210 may include at least one communication module for connecting the voice input apparatus 20 to the appliance control apparatus 10, the voice processing unit 11, the control unit 13, the appliance 30, and/or a user terminal through a network. For example, the communication unit 210 may include a short range communication module such as a Bluetooth and a near field communication (NFC), a wireless Internet module such as Wi-Fi, or a mobile communication module. The controller 243 may transmit a control command to the appliance control apparatus 10, particularly, the voice processing unit 11 or the control unit 13, or transmit a control signal to the appliance 30 through the communication unit 210. In addition, the controller 243 may receive information or data related to the appliance 30 from the voice processing unit 11 or the control unit 13, or may receive information or data from the appliance 30 through the communication unit 210.

The input unit 220 may include input means for inputting a certain signal, information, and/or data to the voice input apparatus 20 by an action such as a user's operation. The input unit 220 may include a microphone 221. In some embodiments, the input unit 220 may include a touch input unit 222 through which a command is inputted through a user's touch operation and/or a button input unit 223 through which a command is inputted through a button manipulation.

The user may control the operation of the voice input apparatus 20 through the button input unit 223. The button input unit 223 may be a button for acquiring a voice including a control command of the appliance 30 from the user. In other words, the button input unit 223 may correspond to a button for activating/deactivating the microphone 221.

For example, after the user presses the button input unit 223 or during pressing, the controller 243 may activate the microphone 221 to acquire a voice uttered by the user. After completing the uttering of the voice, the user may press the button input unit 223 again, or terminate the pressing operation. In this case, the controller 243 may deactivate the microphone 221, and transmit the received voice to the voice processing unit 11.

The user may input a control command for controlling the target appliance through the input unit 220. The user may input a control command in the form of a voice through the microphone 221. Alternatively, the user may input a control command in a text form through the touch input unit 222 or the button input unit 223, or by selecting a menu or icon outputted through the display 232.

The output unit 230 may output information related to an operation or a state of the voice input apparatus 20. According to an embodiment, the output unit 230 may output information or data received from the appliance control apparatus 10. For example, the information or data received from the appliance control apparatus 10 may include information related to the operation or state of the appliance 30, a response or a processing result for the control command inputted through the input unit 220, and the like.

The output unit 230 may include at least one of a speaker 231 for outputting various information or data in the form of voice or sound, a display 232 for outputting the various information or data in the form of text or graphic, and a light output unit 233 for outputting the various information or data through the color or brightness of light, a light emitting pattern, or the like.

The memory 241 may store various data such as control data for controlling operations of components included in the voice input apparatus 20 and data for performing an operation corresponding to an input acquired through the input unit 220.

The controller 243 may control the overall operation of the voice input apparatus 20. In particular, the controller 243 may control the input unit 220 to acquire a control command for the appliance 30 from the user. The controller 243 may transmit the acquired control command to the appliance control apparatus 10 through the communication unit 210. In addition, the controller 243 may receive various information or data from the appliance control apparatus 10 through the communication unit 210, and control the output unit 230 to output the received information or data.

The controller 243 may include hardware such as at least one CPU, microcomputer, AP, or the like.

The power supply unit 242 may supply power required for the operation of each of the components included in the voice input apparatus 20. For example, the power supply unit 242 may correspond to an apparatus which is connected to an external power source and supplies power provided from the power source to the components.

According to an embodiment, the power supply unit 242 may include a battery. The battery may be provided in the voice input apparatus 20, and may be connected to an external power source through a power connection terminal included in the voice input apparatus 20 to be charged. The voice input apparatus 20 equipped with the battery may be implemented as a portable type device that is movable by a user in a specific space.

The power supply unit 242 may further include a wireless power receiver (e.g., a coil) for wirelessly receiving power from the outside. In this case, the voice input apparatus 20 may be seated, attached, or mounted in close proximity to the appliance 30 having a wireless power transmitter or a wireless power charging device, and may receive power from the wireless power transmitter. According to an embodiment, depending on a wireless power transmission method implemented in the power supply unit 242, the voice input apparatus 20 may receive power even in a state of being spaced apart from the wireless power transmitter. The power supply unit 242 may charge the battery by using the supplied power.

The interface unit 235 may provide an interface for connecting the voice input apparatus 20 to other device. The interface unit 235 may provide an interface for a wired connection such as a universal serial bus USB.

The voice input apparatus 20 may be connected to the appliance 30 through the interface unit 235. The appliance 30 may be an appliance having no communication module, but is not limited thereto. That is, the appliance 30 having no communication module may transmit/receive a signal or data with the appliance control apparatus 10 through the voice input apparatus 20.

According to an embodiment, the voice input apparatus 20 may receive power from the appliance 30 through the interface unit 235.

Figure 5:
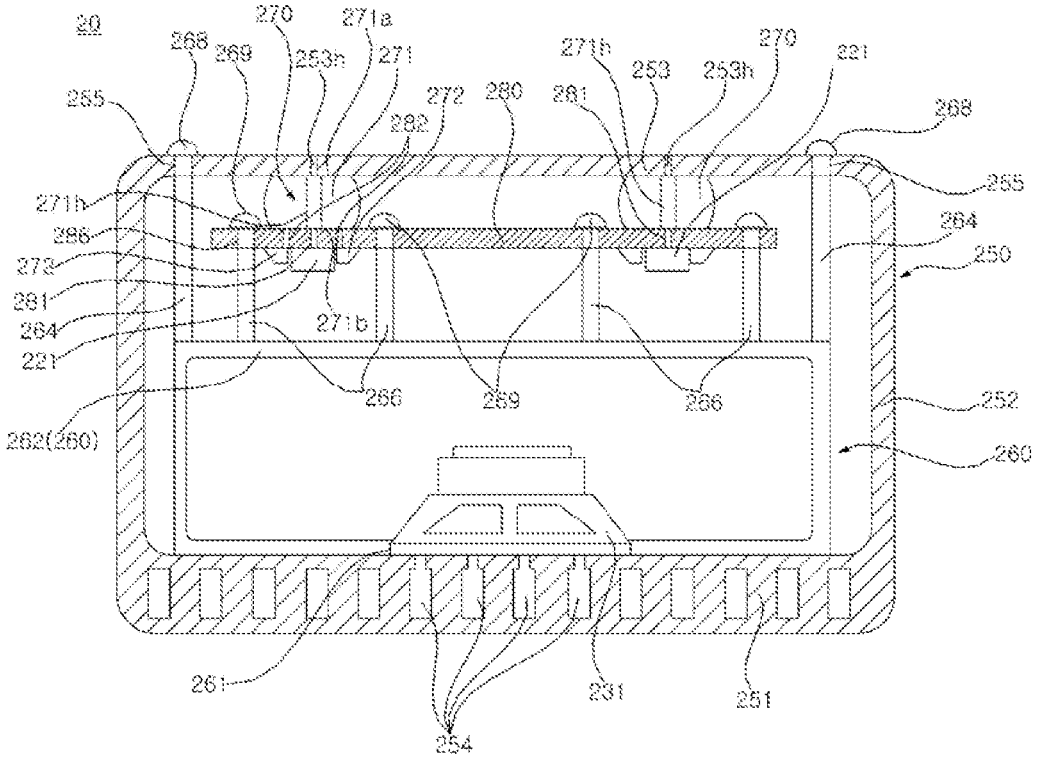
FIG. 5 is a view showing an internal structure by cutting a casing of a voice input apparatus according to an embodiment of the present disclosure.
Figure 6:
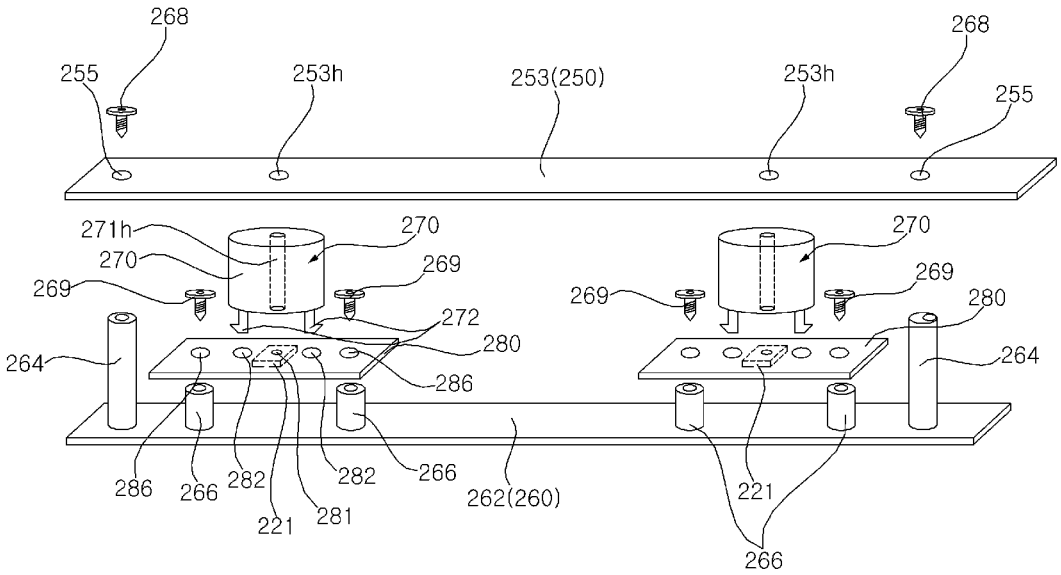
FIG. 6 is a partially exploded perspective view of the voice input apparatus shown in FIG. 6.
Figure 7:
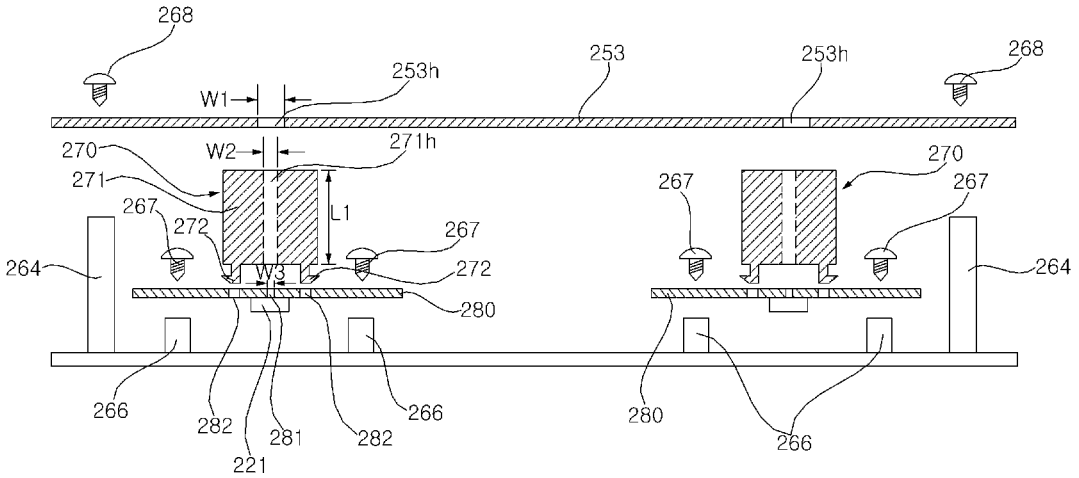
FIG. 7 is a side view of the voice input apparatus shown in FIG. 6.
Figure 8:
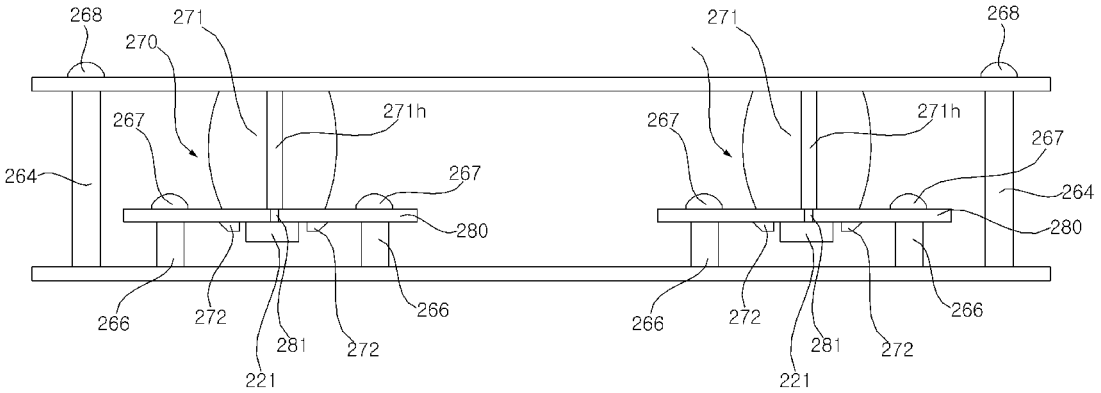
FIG. 8 is an assembly view of the voice input apparatus shown in FIG. 7.

FIG. 5 is a view showing an internal structure by cutting a casing of a voice input apparatus according to an embodiment of the present disclosure. FIG. 6 is a partially exploded perspective view of the voice input apparatus shown in FIG. 6. FIG. 7 is a side view of the voice input apparatus shown in FIG. 6. FIG. 8 is an assembly view of the voice input apparatus shown in FIG. 7.

Referring to FIGS. 5 to 8, the voice input apparatus 20 may be disposed in a location desired by a user in a specific space (e.g., a home) to receive a control command in the form of a voice from the user. In other words, the disposition position of the voice input apparatus 20 may be freely changed by the user.

The voice input apparatus 20 may include a speaker 231 and a speaker room 260 in which the speaker 231 is accommodated. The microphone 221 may be disposed outside the speaker room 260. The microphone 221 may be configured of an integrated circuit (IC) based on micro electro mechanical systems (MEMS).

The speaker 231 may be disposed to output sound downward. The speaker 231 may include a diaphragm (not shown) that vibrates according to an electric signal and emits sound, and the sound by the diaphragm may be outputted downward.

The speaker room 260 may receive at least a portion of speaker 231. The speaker room 260 may serve as a soundbox to resonate sound.

The voice input apparatus 20 may include a casing 250 forming an outer shape. The speaker room 260 may be provided in the casing 250. The casing 250 may include a substantially horizontal base 251, a sidewall 252 extended upwardly from a circumference of the base 251, and a panel 253 closing the opened upper surface of the sidewall 252. In an embodiment, the base 251, the sidewall 252 and the panel 253 are integrally formed to form the casing 250, but are not necessarily limited thereto. That is, in some embodiments, the base 251, the sidewalls 252, and/or the panel 253 may be formed as separate components to configure the casing 250 as an assembly in which they are coupled to each other.

In the speaker room 260, a sound discharge port 261 may be formed to emit sound outputted from the speaker 231. The casing 250 may be provided with a sound output port 254 that communicates with the sound discharge port 261. The output sound of the speaker 231 emitted through the sound discharge port 261 may be outputted to the outside of the casing 250 through the sound output port 254. A plurality of sound output ports 254 may be formed.

The microphone 221 may be disposed outside the speaker room 260. Preferably, the microphone 221 is disposed above the speaker room 260, but is not necessarily limited thereto.

Meanwhile, a voice input hole **253*h* is formed in the casing 250. The voice input hole 253*h* may be formed in the panel 253. A pair of voice input holes 253*h* may be spaced apart at a certain interval. The circuit board 280 is disposed inside the casing 250. The circuit board 280 may be disposed below the panel 253**.

The circuit board 280 may be disposed above the speaker room 260. The circuit board 280 may be fixedly disposed in a position spaced apart by a set distance from an upper surface portion of the room (hereinafter, referred to as a room upper surface portion 262) defining the ceiling of the speaker room 260. A board supporter 266 may be extended upward from the room upper surface portion 262 by the set distance to support the circuit board 280. A plurality of board supporters 266 may be provided.

The board supporter 266 may be a boss having a fastening hole, to which a screw 269 is fastened, formed in an upper end. In the circuit board 280, a screw passing hole 286 may be formed in positions corresponding to the board supporters 266, respectively. The screw 269 may be fastened to the fastening hole through the screw passing hole 286 from the upper side.

At least one voice passing hole 281 is formed in the circuit board 280. Two voice passing holes 281 are spaced apart from each other at a certain interval so as to correspond to the two voice input holes 253*h*, respectively.

A microphone 221 may be provided to receive a control command in the form of a voice. The microphone 221 may be disposed below the circuit board 280. Two microphones 221 may be spaced apart from each other at a certain interval so as to correspond to the two voice passing holes 281, respectively.

Each microphone 221 may be disposed in the bottom surface of the circuit board 280. Here, the bottom surface of the circuit board 280 may be a surface facing the speaker room 260. The microphone 221 may be disposed in an area where a voice receiving hole (not shown) which receives a sound (or voice) is overlapped with the voice passing hole 281. That is, when viewed from above, at least a portion of the voice receiving hole may be overlapped with the voice passing hole 281 and is preferably positioned inside the voice passing hole 281.

A sealer 270 is provided to guide the voice inputted through the voice input hole 253*h* to the voice passing hole 281. The sealer 270 may be made of a flexible, deformable, soft or compressible material. For example, the sealer 270 may be made of silicon.

The sealer 270 may include a guide pipe 271 and a hook 272. The guide pipe 271 may be formed in a cylindrical shape having a hollow 271*h* and disposed between the panel 253 and the circuit board 280.

The guide pipe 271 has an upper surface 271*a*, which defines an upper end of the hollow 271*h*, that is in contact with a bottom surface of the panel 253 while surrounding the voice input hole 253*h*, and has a lower surface 271*b*, which defines a lower end of the hollow 271*h*, that is in contact with an upper surface of the circuit board 280 while surrounding the voice passing hole 281.

Specifically, the hollow 271*h* of the guide pipe 271 may be overlapped with the voice input hole 253*h*. The diameter W1 of the voice input hole 253*h* may be larger than the diameter W2 of the hollow 271*h* (W1>W2). When viewed from above, the hollow 271*h* may be positioned inside the voice input hole 253*h*.

The diameter W2 of the hollow 271*h* may be larger than the diameter W3 of the voice passing hole 281 (W2>W3). When viewed from above, the voice passing hole 281 may be positioned inside the hollow 271*h*.

The hook 272 may protrude from the lower surface of the guide pipe 271. A pair of hooks 272 may be provided in both sides of the hollow 271*h* interposed therebetween. A binding hole 282 is formed in the circuit board 280, and the hook 272 may pass through the binding hole 282 to be caught by the bottom surface of the circuit board 280. A pair of binding holes 282 may also be provided to correspond to the pair of hooks 272.

Even when the binding hole 282 is formed to have a relatively small size in comparison with the hook 272, the hook 272 made of soft material can pass through the binding hole 282 as it is deformable, and after passing through, it is restored to an original shape and is not separated from the binding hole 282.

It may be considered that the sealer 270 is only provided with the guide pipe 271 without the hook 272, and the guide pipe 271 is attached to the upper surface of the circuit board 280 by using double-sided tape. However, in this case, when the double-sided tape is adhered, air may enter the adhesive surface, or the double-sided tape may be folded, torn, sagged, etc., thereby causing quality problems. In addition, it is not easy to attach the double-sided tape in a correct place manually, and there are various problems such as difficulty in work due to thin thickness, and change in adhesiveness due to changes in ambient temperature.

On the other hand, since the present disclosure is implemented to fix the sealer 270 by a mechanical coupling between the hook 272 and the binding hole 282, there is an advantage that can solve the above-described various problems.

Meanwhile, a bridge 264 connecting between the casing 250 and the speaker room 260 may be provided. The bridge 264 may further include the bridge 264 for maintaining the distance L2 between the panel 253 and the circuit board 280 to be smaller than the length L1 of the guide pipe 271 at the time of non-compression (L2<L1). Since the guide pipe 271 is maintained in a compressed state, the upper surface of the guide pipe 271 is in close contact with the bottom surface of the panel 253, and the lower surface of the guide pipe 271 is in close contact with the circuit board 280, so that leakage of sound may be prevented.

One end of the bridge 264 may be connected to the speaker room 260, and the other end thereof may be connected to the panel 253. The length of the bridge 264, i.e., the length from the one end to the other end is constant.

The bridge 264 may be a boss that protrudes from the speaker room 260 and has a fastening hole formed in an upper end thereof. In this case, the panel 253 may have a screw passing hole 255 formed in a position corresponding to the fastening hole. The screw 268 may be fastened to the fastening hole through the screw passing hole 255 from the upper side. A plurality of bridges 264 may be provided, and correspondingly, a plurality of screw passing holes 255 may be provided.

Figure 9:
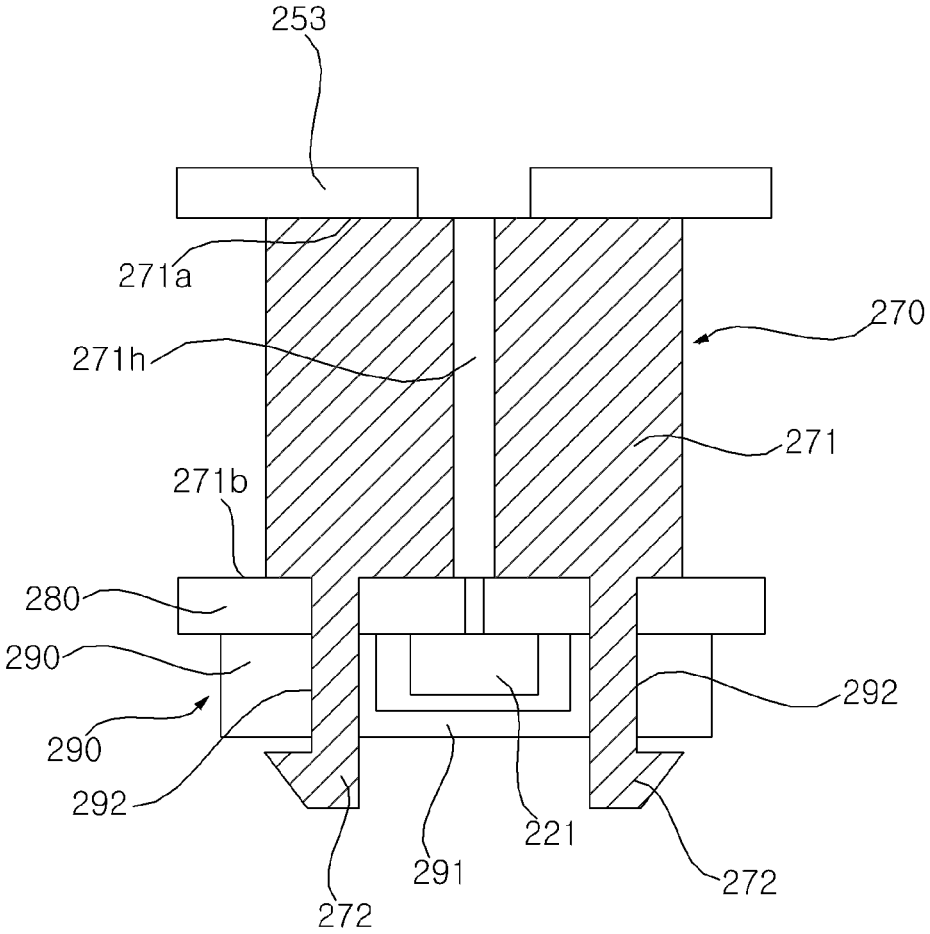
FIG. 9 is a partial view of a voice input apparatus according to another embodiment of the present disclosure.

FIG. 9 is a partial view of a voice input apparatus according to another embodiment of the present disclosure. Referring to FIG. 9, the voice input apparatus according to another embodiment of the present disclosure is different from the above-described embodiment in that a hook fixing member 290 for fixing the sealer 270 is provided in the lower side of the circuit board 280. Hereinafter, the same reference numeral is assigned to the same configuration as the above-described embodiment, and a description thereof will be omitted.

The hook fixing member 290 is disposed below the circuit board to accommodate the microphone 221. The hook fixing member 290 may have a receiving portion 291 having an opening formed on an upper surface thereof, and the microphone 221 may be accommodated into the receiving portion 291 through the opening. The hook fixing member 290 is preferably made of a soft material, but is not necessarily limited thereto.

A first binding hole 282 is provided in the circuit board 280, and a second binding hole 292 is formed in the hook fixing member 290. The pair of second binding holes 292 may be formed in a position corresponding to a pair of first binding holes 282. The hook 272 may pass through the first binding hole 282 and the second binding hole 292 to be caught by the bottom surface of the hook fixing member 290. In particular, in a state where the hook 272 is caught by the bottom surface of the hook fixing member 290, the upper surface of the hook fixing member 290 may be in close contact (sealing) with the bottom surface of the circuit board 280.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, the scope of the present disclosure is not construed as being limited to the described embodiments but is defined by the appended claims as well as equivalents thereto.

The invention claimed is:

1. A voice input apparatus comprising:

a panel in which a voice input hole is formed;

a circuit board which is disposed below the panel, and has a voice passing hole and a binding hole formed in a position corresponding to the voice input hole;

a microphone which is disposed below the circuit board, and provided with a voice receiving hole in a position corresponding to the voice passing hole; and a sealer which guides a voice inputted through the voice input hole to the voice passing hole, wherein the sealer comprises:

a guide pipe which is formed in a cylindrical shape having a hollow and disposed between the panel and the circuit board, has an upper surface defining an upper end of the hollow is in contact with a bottom surface of the panel while surrounding the voice input hole, and has a lower surface defining a lower end of the hollow is in contact with an upper surface of the circuit board while surrounding the voice passing hole; and a hook which protrudes from the lower surface of the guide pipe and passes through the binding hole to be caught by a bottom surface of the circuit board.

2. The voice input apparatus of claim 1, wherein the guide pipe is made of a compressible soft material.

3. The voice input apparatus of claim 2, further comprising:

a speaker room provided below the microphone; and a speaker disposed inside the speaker room, wherein the circuit board is spaced apart from an upper surface portion of the speaker room by a set distance, wherein the voice input apparatus further comprises a bridge which connects the speaker room and the panel to maintain a distance between the panel and the circuit board to be smaller than a length of the guide pipe when not compressed.

4. The voice input apparatus of claim 3, further comprising a board supporter which is extended upward from the upper surface portion of the speaker room by the set distance and supports the circuit board.

5. The voice input apparatus of claim 3, wherein an upper end of the bridge and the panel are screwed together.

6. The voice input apparatus of claim 2, wherein the sealer is made of silicon.

7. The voice input apparatus of claim 1, wherein, when viewed from above, the hollow is positioned inside the voice input hole.

8. The voice input apparatus of claim 7, wherein, when viewed from above, the voice passing hole is positioned inside the hollow.

9. A voice input apparatus comprising:

a panel in which a voice input hole is formed;

a circuit board which is disposed below the panel, and has a voice passing hole and a first binding hole formed in a position corresponding to the voice input hole;

a microphone which is disposed below the circuit board, and provided with a voice receiving hole in a position corresponding to the voice passing hole;

a hook fixing member which is disposed below the circuit board to accommodate the microphone, and has a second binding hole: and a sealer which guides a voice inputted through the voice input hole to the voice passing hole, wherein the sealer comprises:

a guide pipe which is formed in a cylindrical shape having a hollow and disposed between the panel and the circuit board, has an upper surface defining an upper end of the hollow is in contact with a bottom surface of the panel while surrounding the voice input hole, and has a lower surface defining a lower end of the hollow is in contact with an upper surface of the circuit board while surrounding the voice passing hole; and a hook which protrudes from the lower surface, and passes through the first binding hole and the second binding hole sequentially to be caught by a bottom surface of the hook fixing member.

10. The voice input apparatus of claim 9, wherein the hook fixing member comprises a receiving portion having an opening formed on an upper surface, and the microphone is accommodated into the receiving portion through the opening.

11. The voice input apparatus of claim 10, wherein, in the hook fixing member, a circumference of the opening is in close contact with the bottom of the circuit board, in a state where the hook is caught by the bottom surface of the hook fixing member.

12. The voice input apparatus of claim 11, wherein the hook fixing member is made of a soft material.

* * * * *